US005943871A

United States Patent [19]

Ito et al.

[11] Patent Number: 5,943,871

[45] Date of Patent: Aug. 31, 1999

[54] THERMAL EXPANSION VALVE

[75] Inventors: Yasunobu Ito, Anjo; Teruyuki Hotta, Nagoya; Norihide Kawachi, Kariya, all of Japan

[73] Assignee: Denso Corporation, Kariya, Japan

[21] Appl. No.: 08/920,566

[22] Filed: Aug. 29, 1997

[30] Foreign Application Priority Data

Sep. 2, 1996 [JP] Japan ..... 8-232255

[51] Int. Cl.[6] ..... F25B 41/04

[52] U.S. Cl. ..... 62/225; 236/92 B

[58] Field of Search ..... 236/92 B; 62/225

[56] References Cited

U.S. PATENT DOCUMENTS

| | | | |
|---|---|---|---|
| 3,667,247 | 6/1972 | Proctor | 62/217 |
| 3,822,563 | 7/1974 | Orth | 62/225 |
| 4,542,852 | 9/1985 | Orth et al. | 62/225 |
| 5,303,864 | 4/1994 | Hirota | 236/92 B |
| 5,361,597 | 11/1994 | Hazime et al. | 62/225 |

FOREIGN PATENT DOCUMENTS

A-7-218046 8/1995 Japan .

*Primary Examiner*—William E. Tapolcai
*Attorney, Agent, or Firm*—Harness, Dickey & Pierce, PLC

[57] ABSTRACT

An expansion valve includes a temperature sensing rod made of metal, for sensing a temperature of refrigerant in an evaporator outlet side passage. A first pressure chamber and a second pressure chamber are separated by a diaphragm. The temperature sensing rod include a small-diameter shaft portion and a diaphragm stopper portion which is connected to an end of the small-diameter shaft portion and contacts the diaphragm. The evaporator outlet side passage and the second pressure chamber are communicated through a space. A heat transmission delay member made of resin is press-fitted to the temperature sensing rod, and includes a thin cylindrical portion which covers a part of the small-diameter shaft portion, placed in the evaporator outlet side passage, a thick cylindrical portion which covers a part of the small-diameter portion, placed in the space and the thick circular plate which covers the diaphragm stopper portion.

23 Claims, 5 Drawing Sheets

THERMAL EXPANSION VALVE

CROSS-REFERENCE TO RELATED APPLICATION

This application is related to and claims priority from Japanese Patent Application No. H8-232255 filed on Sep. 2, 1996, the contents of which are hereby incorporated by reference.

BACKGROUND OF THE INVENTION

1. Field of the Invention

The present invention relates to a thermal expansion valve for a refrigerating cycle in an automotive air conditioning system, for example. More particularly, the present invention relates to a thermal expansion valve having a temperature sensing portion for preventing a hunting from being caused in the thermal expansion valve.

2. Description of Related Art

Generally, an expansion valve of a refrigerating cycle senses a temperature of refrigerant at an outlet of an evaporator and adjusts a flow amount of refrigerant of the refrigerant cycle by changing a valve opening degree of a valve body so that a superheating degree of refrigerant at the outlet of the evaporator is maintained at a predetermined value according to a variation of a heat load of the evaporator.

In an automotive air conditioning system, by a variation of a rotational speed of an engine used as a driving source of a compressor and a rapid variation of the heat load of the evaporator, the temperature sensing portion for sensing a temperature of refrigerant at the outlet of the evaporator is operated to frequently changes the valve opening degree. Therefore, the hunting is caused in the expansion valve.

When the hunting caused in the expansion valve becomes severe, the temperature of air to be blown into the passenger compartment greatly changes so that an unpleasant feeling is given to a passenger in a passenger compartment.

To suppress the hunting from being caused in the expansion valve, in an expansion valve described in JOURNAL OF NIPPONDENSO TECHNICAL DISCLOSURE NO. 68-153 published on Nov. 15, 1989, outer surfaces of a part of temperature sensing rod, placed at a side of a diaphragm and a diaphragm stopper, are formed of a resinous material having a small heat conductivity.

However, in the conventional expansion valve, because the temperature sensing rod is directly exposed to a refrigerant passage at an evaporator outlet side, the temperature of refrigerant at the evaporator outlet side is excessively sensitively sensed by the exposed portion of the temperature sensing rod. Therefore, the hunting caused in the expansion value cannot be suppressed sufficiently.

SUMMARY OF THE INVENTION

In view of the foregoing problems, it is an object of the present invention to provide a thermal expansion valve in which the hunting from being caused in the expansion valve is sufficiently suppressed.

It is an another object of the present invention to provide a thermal expansion valve in which a heat transmission delay member for suppressing the hunting from being caused in the expansion valve is readily assembled.

Further, it is another object of the present invention to provide a thermal expansion valve in which the hunting from being caused in the expansion valve is sufficiently suppressed while refrigerant smoothly flows through an evaporator outlet side passage.

According to the present invention, an outer peripheral surface of the small-diameter shaft portion placed in an evaporator outlet side passage is covered by a first cylindrical portion of a heat transmission delay member. It is compared with a case where the temperature sensing rod is directly exposed in the evaporator outlet passage, the responsibility of the temperature sensing rod relative to the temperature variation of refrigerant at an evaporator outlet is delayed appropriately by the first cylindrical portion. Further, because the first cylindrical portion has a thin wall, the temperature sensing rod can sufficiently sense the temperature of refrigerant at the evaporator outlet.

Further, a part of the temperature sensing rod, placed in a pressure-introducing space, is covered by a second cylindrical portion having a thickness thicker than that of the first cylindrical portion. Therefore, when liquid refrigerant stays in the pressure-introducing space, it can prevent to supercool the temperature sensing rod by the liquid refrigerant staying in the space. As a result, relative to the repetitive variation of the temperature of refrigerant in the evaporator outlet side passage and the space, heat is transmitted to the temperature sensing rod to have a moderate delay.

Preferably, a circular plate covers a diaphragm stopper portion of the temperature sensing rod and has a thickness thicker than that of the first cylindrical portion. Thus, it can prevent to supercool the diaphragm stopper portion by liquid refrigerant staying in the space.

More preferably, the first cylindrical portion, the second cylindrical portion and the circular plate are made of resin, and are formed integrally. Therefore, the heat transmission delay member can be simply formed.

Further, the first cylindrical portion and the second cylindrical portion are connected to have a step portion therebetween, and the step portion is not disposed in the evaporator outlet side passage. Therefore, the refrigerant flow is not interrupted by the step portion, and refrigerant smoothly flows in the evaporator outlet side passage.

Further, the heat transmission delay member is press-fitted to the temperature sensing rod. Therefore, the assembling performance of the heat transmission delay member can be improved.

Preferably, supplemental fixing means for supplementally fixing the heat transmission delay member to said temperature sensing rod is also used. Therefore, the heat transmission delay member can be tightly fixed to the temperature sensing rod.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention are described hereinafter with reference to the accompanying drawings.

Figure 1:
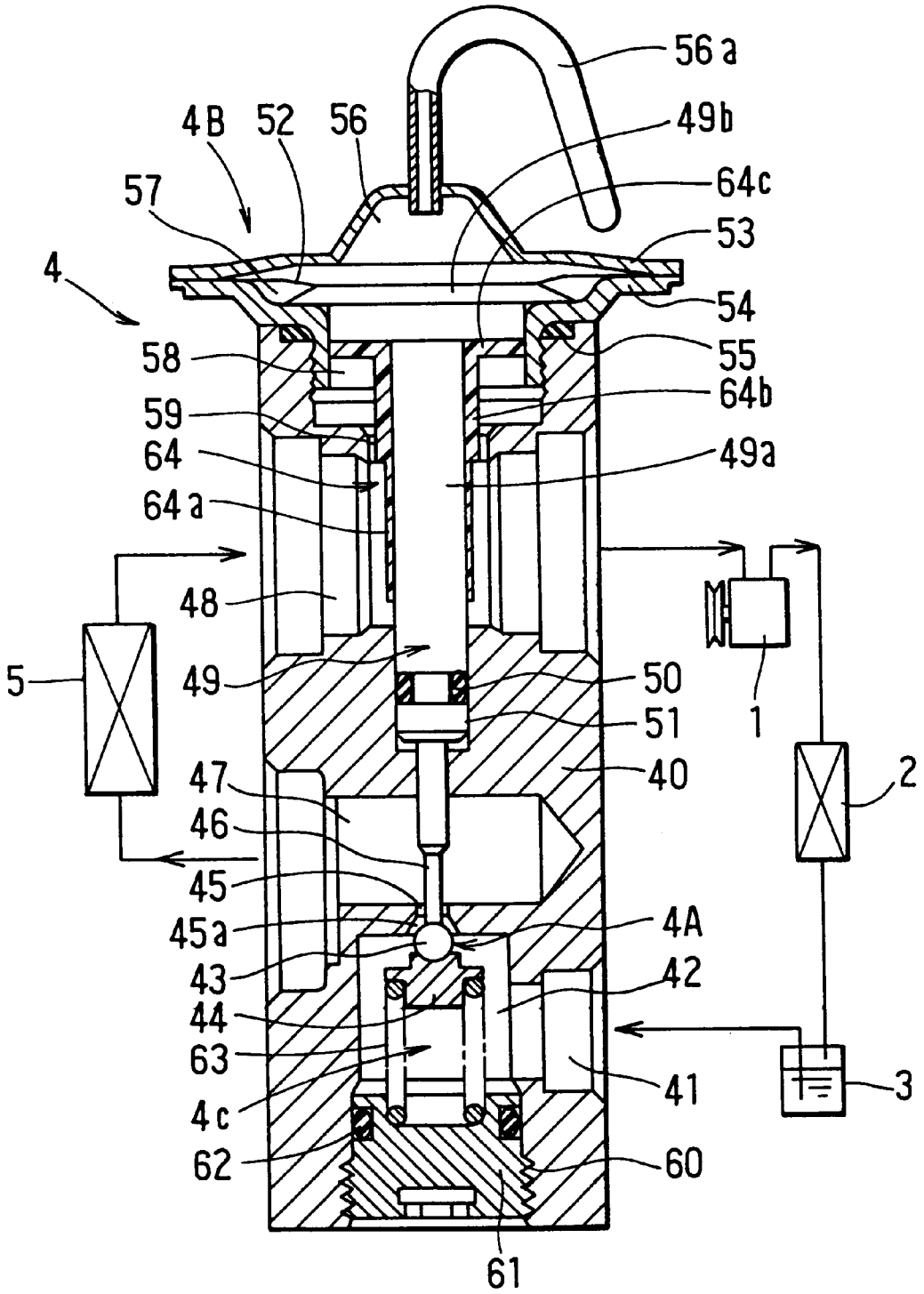
FIG. 1 is a diagrammatic view showing a refrigerating cycle having a thermal expansion valve according to a first preferred embodiment of the present invention.
Figure 2:
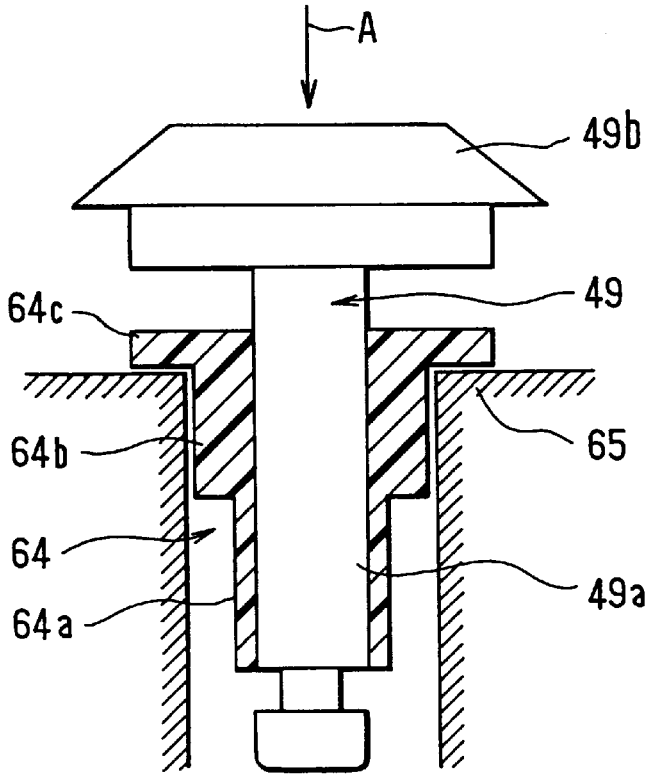
FIG. 2 is a diagrammatic view showing a press-fitting method of a heat transmission delay member in the thermal expansion valve shown in FIG. 1.

A first preferred embodiment of the present invention will be described with reference to FIGS. 1 and 2. FIG. 1 illustrates a refrigerating cycle for an automotive air conditioning system, to which a thermal expansion valve 4 of the present invention is applied. A compressor 1 for compressing and discharging refrigerant is disposed in an engine compartment of a vehicle and is driven by an engine (not shown). Gas refrigerant discharged from the compressor 1 is cooled and condensed in a condenser 2 disposed in the engine compartment. The condensed refrigerant is separated by a receiver 3 into gas-phase refrigerant and liquid-phase refrigerant, and only liquid-phase refrigerant is discharged from the receiver 3.

A thermal expansion valve 4 (herein after referred to as "expansion valve") of the refrigerating cycle adjusts a valve opening degree to maintain a superheating degree of refrigerant at an outlet portion of an evaporator 5 provided in a cooling unit of an air conditioning system at a predetermined degree. The expansion valve 4 and the evaporator 5 are generally disposed in the passenger compartment in a vehicle.

Next, a structure of the expansion valve 4 will be described. A body case 40 of the expansion valve 4 is made of metal such as aluminum and is formed approximately in a rectangular parallelopiped shape. A refrigerant inlet 41 in which the liquid-phase refrigerant from the receiver 3 of the refrigerating cycle flows is opened at a lower-right side of the body case 40.

The refrigerant inlet 41 communicates with a valve body chamber 42 formed at a lower center portion of the body case 40. In the valve body chamber 42, a spherical valve body 43 and a supporting member 44 contacting and supporting the valve body 43 are contained. Here, a liquid refrigerant passage of the expansion valve 4 is formed by the refrigerant inlet 41 and the valve body chamber 42.

A restriction passage 45 for decompressing liquid refrigerant is formed at a downstream refrigerant side of the liquid refrigerant passage, and the opening degree of the restriction passage 45 is adjusted by the valve body 43. A conical valve seat 45*a* is formed in the restriction passage 45 to be opposite to the valve body 43. In the first embodiment, by the restriction passage 45 decompressing and expanding liquid refrigerant and the valve body 43 adjusting the opening degree of the restriction passage 45, a valve body mechanism portion 4A of the expansion valve 4 is constructed.

A valve rod 46 is disposed to penetrate through a center portion of the restriction passage 45, and the lower end of the valve rod 46 contacts the valve body 43. The gas-liquid two phase refrigerant decompressed while passing through the restriction passage 45 further flows a refrigerant passage 47. The refrigerant passage 47 is formed approximately at a center portion in an up-down direction of the body case 40, and is connected to a refrigerant inlet portion of the evaporator 5.

Gas refrigerant evaporated in the evaporator 5 flows through an evaporator outlet side passage 48, and the evaporator outlet side passage 48 is formed in a cylindrical shape at an upper side of the body case 40 to penetrate through the body case 40 in the left-right direction in FIG. 1. An inlet end (i.e., the left end in FIG. 1) of the evaporator outlet side passage 48 is connected to a refrigerant outlet portion of the evaporator 5, and an outlet end (i.e., the right end in FIG. 1) thereof is connected an intake port of the compressor 1.

A temperature sensing rod 49 of the expansion valve 4 is made of a metal such as aluminum, having a sufficient heat conductivity, and is formed in a cylindrical shape. The temperature sensing rod 49 is disposed to penetrate through the evaporator outlet side passage 48, and senses a temperature of superheating gas refrigerant evaporated in the evaporator 5. Since the temperature sensing rod 49 is disposed to penetrate through the evaporator outlet side passage 48 in which superheating gas refrigerant flows, the heat of the superheating gas refrigerant is transmitted to the temperature sensing rod 49 to sense the temperature of the superheating gas refrigerant.

The temperature sensing rod 49 includes a small-diameter shaft portion 49*a* penetrating through the evaporator outlet side passage 48 and a diaphragm stopper portion 49*b* contacting a diaphragm 52 described later. The diaphragm stopper portion 49*b* is formed in a circular plate, and the diameter of the diaphragm stopper portion 49*b* is expanded from a top end portion (i.e., the end portion at a side of the diaphragm 52) of the temperature sensing rod 49.

Next, a temperature sensing element portion 4B for operating the valve body 43 of the expansion valve 4 will be described. A top end of the valve rod 46 connected to the valve body 43 contacts a bottom surface of the temperature sensing rod 49. An O-ring 50 for sealing is disposed on an outer peripheral groove portion proximate to a lower end of the small-diameter shaft portion 49*a* of the temperature sensing rod 49 so that the temperature sensing rod 49 is air-tightly slidably inserted into a hole 51 of the body case 40.

The diaphragm stopper portion 49*b* formed at the upper end portion of the temperature sensing rod 49 contacts the diaphragm (i.e., pressure responding member) 52 disposed at an outer side of the top portion of the body case 40. Thus, when the diaphragm 52 is displaced in the up-down direction in FIG. 1, the valve body 43 is also displaced through the temperature sensing rod 49, the valve rod 46 according to the displacement of the diaphragm 52. In the first embodiment, a displacement transmission member is constructed by the valve rod 46 and the temperature sensing rod 49.

An outer peripheral portion of the diaphragm 52 is held between upper side and lower side case members 53 and 54 to support the diaphragm 52 therebetween. The case members 53 and 54 are each made of a metal material such as stainless steel (e.g., SUS304), and are integrally bonded to each other by welding or the like. The lower side case member 54 is fixed to the top end portion of the body case 40 by a screw. The fixing portion by a screw is air-tightly sealed by a rubber elastic seal member 55.

A space between the case members 53 and 54 is separated into an upper side chamber (i.e., first pressure chamber) 56 and a lower side chamber (i.e., second pressure chamber) 57.

A capillary tube 56*a* for filling refrigerant is formed in the upper side chamber 56. Because the top end of the capillary tube 56*a* is closed, the upper side chamber 56 is a sealed space. Within the upper side chamber 56, the same type refrigerant gas as the refrigerant circulating in the refrigerating cycle is sealingly filled. A temperature of superheating gas refrigerant at the evaporator outlet is sensed by the temperature sensing rod 49 and is transmitted to the gas refrigerant sealed in the upper side chamber 56 through the diaphragm 52, and the pressure of the gas refrigerant sealed in the upper side chamber 56 is changed to correspond to the temperature of the superheating gas refrigerant at the evaporator outlet.

Thus, suitably, the diaphragm 52 is made of a rigid material having a sufficient elasticity and heat-conductivity, for example, a metal such as a stainless steel (i.e., SUS304).

On the other hand, the lower side chamber 57 communicates with the evaporator outlet side passage 48 through a space around the diaphragm stopper portion 49*b* of the temperature sensing rod 49, a space for introducing a pressure thereinto and a circular communicating passage 59, so that the pressure of refrigerant in the evaporator outlet side passage 48 is introduced into the lower side chamber 57. That is, the pressure of refrigerant in the lower side chamber 57 is similar to that in the evaporator outlet side passage 48.

A supporting mechanism 4C of the valve body 43 is formed in a lower end portion of the body case 40. Here, the supporting mechanism 4C of the valve body 43 will be described. A screw hole 60 opened at an outside of the body case 40 is formed in the lower end portion of the body case 40, and an adjustment nut 61 is screwed into the screw hole 60. An O-ring 62 for seal is attached around an outer peripheral portion of the adjustment nut 61, thereby a clearance between the adjustment nut 61 and the screw hole 60 is air-tightly sealed.

One end of a coil spring 63 (i.e., spring means) is supported by the adjustment nut 61, and another end of the coil spring 63 is supported by the supporting member 44 of the valve body 43. Thus, by adjusting the screwing position of the adjustment nut 61, a preset load of the coil spring 63 can be adjusted.

Next, the structures for suppressing the hunting from being caused in a valve operation of the expansion valve will be described.

As shown in FIG. 1, a heat transmission delay member 64 is attached on an outer peripheral surface of the temperature sensing rod 49.

The heat transmission delay member 64 is made of a material (e.g., resin) having a sufficient low heat-conductivity which is lower than aluminum, and is press-fitted to the outer peripheral surface of the temperature sensing rod 49.

As the material of the heat transmission delay member 64, suitably, resin such as polyacetal or nylon, having a sufficient refrigerant resistance, a sufficient oil resistance, a sufficient cold resistance and an elasticity is used.

The heat transmission delay member 64 includes a thin cylindrical portion 64*a*, a thick cylindrical portion 64*b* connected to an end of the thin cylindrical portion 64*a*, and a thick circular plate portion 64*c* formed to extend from an end of the thick cylindrical portion 64*b* radially outwardly.

The thin cylindrical portion 64*a* are attached approximately on an outer surface of a part of the shaft portion 49*a*, placed in the evaporator outlet side passage 48.

The thick cylindrical portion 64*b* is attached on an outer surface of a part of the shaft portion 49*a*, placed in the space 58 and the circular communicating passage 59.

The stepped portion (i.e., the connecting portion) between the thin cylindrical portion 64*a* and the thick cylindrical portion 64*b* is not placed in the evaporator outlet side passage 48, and is placed in the circular communicating passage 59.

Further, the thick circular plate portion 64*c* is disposed on a bottom surface side of the diaphragm stopper 49*b* to cover the bottom surface side.

For example, when the diameter of the shaft portion 49*a* of the temperature sensing rod 49 is 5.6 mm, the thickness of the thin cylindrical portion 64*a* is 0.5 mm, the thickness of the thick cylindrical portion 64*b* is 1.45 mm, and the thickness of the circular plate portion 64*c* is 1.0 mm. The thickness of the circular plate portion 64*c* may be similar to that of the thick cylindrical portion 64*b*.

A method for press-fixing the heat transmission delay member 64 to the temperature sensing rod 49 will be described. As shown in FIG. 2, the circular plate portion 64*c* of the heat transmission delay member 64 is placed on a die 65, and the heat transmission delay member 64 is fixed to the die 65. At this state, the small-diameter shaft portion 49*a* of the temperature sensing rod 49 is press-inserted into a center hole portion of the heat-transmission delay member 64 in a direction shown by an arrow "A" in FIG. 2.

Next an operation of the expansion valve 4 will be described.

When the compressor 1 is actuated and refrigerant circulates in the refrigerating cycle, the temperature of the superheating gas refrigerant passing through the evaporator outlet side passage 48 is transferred to the sealed gas refrigerant in the upper side chamber 56 of the diaphragm 52 through the temperature sensing rod 49 and the diaphragm 52. Therefore, the pressure in the upper side chamber 56 is set to a pressure corresponding to the temperature of the superheating gas refrigerant in the evaporator outlet side passage 48. On the other hand, the pressure in the lower side chamber 57 of the diaphragm 52 is set to the pressure of refrigerant in the evaporator outlet side passage 48.

Thus, by the pressure difference between the upper side chamber 56 and the lower side chamber 57 and the preset load of the coil spring 63 pressing the valve body 43 to the upper side, the valve body 43 is displaced in the up-down direction in FIG. 1. According to the displacement of the valve body 43, the opening degree of the restriction passage 45 is regulated so that the refrigerant flow of the expansion valve 4 is automatically regulated. By the regulation of the refrigerant flow, the superheating degree of gas refrigerant at the evaporator outlet is maintained at a predetermined degree. Here, the superheating degree of gas refrigerant at the evaporator outlet can be changed by changing the preset load of the coil spring 63.

By a variation of a rotational number of the engine used as a driving source of the compressor 1 and a rapid variation of the heat load of the evaporator 5, the expansion valve 4 frequently changes the valve opening degree of the valve body 43 (i.e., the opening degree of the restriction passage 45) according to a temperature sensed by the temperature sensing rod 49 for sensing the temperature of refrigerant at the outlet of the evaporator. Therefore, the hunting may be caused in the expansion valve. Further, in recent years, a supercooling portion for supercooling liquid refrigerant flowing from the receiver 3 is provided in the condenser 2, and the supercooled liquid refrigerant flows into the expansion valve 4 to increase cooling capacity of a refrigerating cycle. However, in the refrigerating cycle having the supercooling function, since liquid refrigerant is supercooled, a refrigerant-flow variation in the expansion valve 4 becomes larger relative to the variation of temperature so that the hunting is further likely caused in the expansion valve.

According to the first embodiment of the present invention, the hunting can be effectively suppressed from being caused in the expansion valve by the following reasons.

(1) The outer peripheral surface of the small-diameter shaft portion 49*a* placed in the evaporator outlet side passage 48 is covered by the thin cylindrical portion 64*a* of the heat transmission delay member 64. It is compared with a case where the temperature sensing rod 49 is directly exposed in the evaporator outlet passage 48, the responsibility of the temperature sensing rod 49 relative to the temperature variation of refrigerant at the evaporator outlet is appropriately delayed by the thin cylindrical portion. Further, because the cylindrical portion 64*a* has a thin wall, the temperature sensing rod 49 can sufficiently sense the temperature of refrigerant at the evaporator outlet.

(2) The temperature sensing rod 49 placed in the space 58 and the circular communication passage 59 are covered by the thick cylindrical portion 64*b*. Therefore, when liquid refrigerant stays in the space 58, it can prevent to supercool the temperature sensing rod 49 by the liquid refrigerant staying in the space 58.

(3) The lower side of the diaphragm stopper portion 49*b* in the temperature sensing rod 49 is covered by the thick circular plate 64*c*.Therefore, it can prevent to supercool the diaphragm stopper portion 49*b* by the liquid refrigerant staying in the space 58.

(4) Because the thick cylindrical portion 64*b* is disposed in the circular communication passage 59, the sectional area of the circular communication passage 59 can be reduced according as the thickness of the thick cylindrical portion 64*b*. Thus, refrigerant flowing in the space 58 through the circular communication portion 59 can be restricted.

The temperature variation due to the liquid refrigerant staying in the space 58 is not directly related to the superheating control of refrigerant at the evaporator outlet. Therefore, the thick cylindrical portion 64*b* and the thick circular plate portion 64*c* are provided on a portion where the temperature sensing rod 49 contacts the space 58 to effectively prevent to supercool the temperature sensing rod 49 by the liquid refrigerant staying in the space 58.

As a result, relative to the repetitive variation of the temperature of refrigerant in the evaporator outlet side passage 48 and the space 58, heat is transmitted to the temperature sensing rod 49 to delay the responsibility appropriately. That is, the temperature sensing rod 49 senses the temperature of refrigerant in the evaporator outlet side passage 48 by a moderate delay. Thus, the hunting can be effectively suppressed from being caused in the valve body 43 of the expansion valve 4.

Further, because the step portion between the thin cylindrical portion 64*a* and the thick cylindrical portion 64*b* is placed in the circular communication passage 59 so as not to be placed in the evaporator outlet side passage 48. Therefore, refrigerant can smoothly flows in the evaporator outlet side passage 48 without interrupting the refrigerant flow in the evaporator outlet side passage 48 by the step portion.

A second preferred embodiment of the present invention will be described with reference to FIG. 3.

Figure 3:
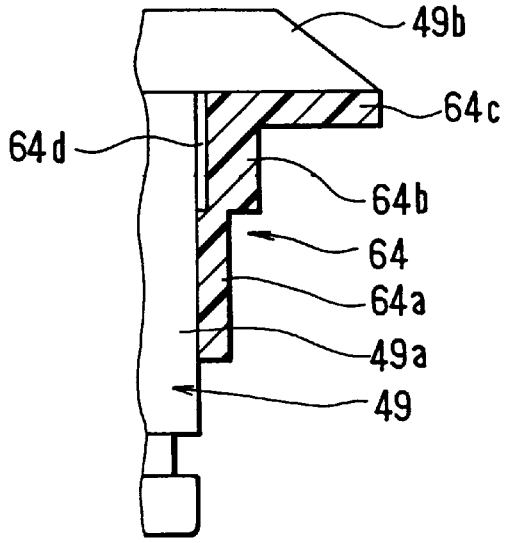
FIG. 3 is a cross-sectional view showing a main portion of a thermal expansion valve according to a second preferred embodiment of the present invention.

As shown in FIG. 3, a small circular clearance 64*d* is formed between inner peripheral surfaces of the thick cylindrical portion 64*b* and the thick circular plate portion 64*c* and the outer peripheral surface of the small-diameter shaft portion 49*a* of the temperature sensing rod 49. In the second embodiment, the clearance 64*d* is about 0.1 mm. By forming the circular clearance 64*d,* is can prevent to cause a crack in the thick cylindrical portion 64*b* and the thick circular plate 64*c* when the heat transmission delay member 64 is press-fitted to the temperature sensing rod 49.

In the first embodiment, the diaphragm stopper 49*b* is formed in double circular plates. However, in the second embodiment, the diaphragm stopper 49*b* is formed in a circular plate.

A third preferred embodiment of the present invention will be described with reference to FIG. 4.

Figure 4:
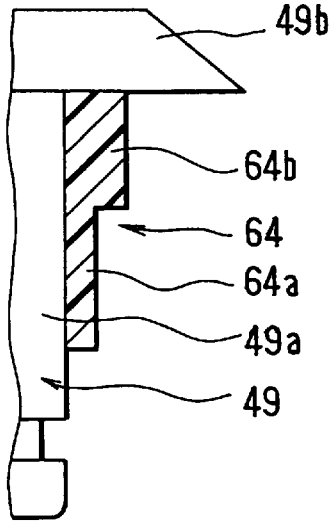
FIG. 4 is a cross-sectional view showing a main portion of a thermal expansion valve according to a third preferred embodiment of the present invention.

As shown in FIG. 4, in the third embodiment, the thick circular plate portion 64*c* connected to the one end of the thick cylindrical portion 64*b* is not formed in the heat transmission delay member 64. In the expansion valve 4, the hunting caused in the valve body 43 can be suppressed by the heat transmission delay operation of the heat-transmission delay member 64.

A fourth preferred embodiment of the present invention will be described with reference to FIG. 5.

Figure 5:
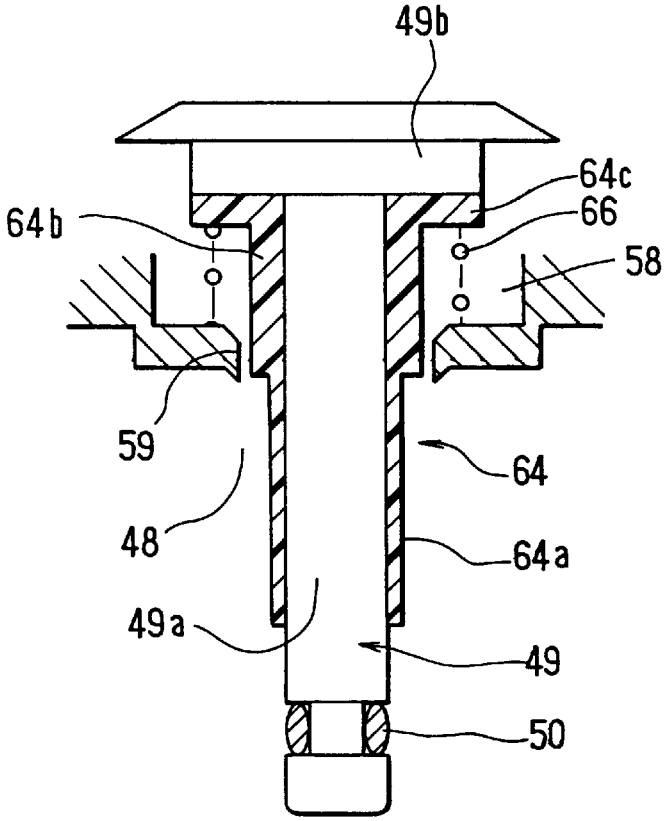
FIG. 5 is a cross-sectional view showing a main portion of a thermal expansion valve according to a fourth preferred embodiment of the present invention.

As shown in FIG. 5, in the fourth embodiment, the heat transmission delay member 64 is press-fitted to the temperature sensing rod 49, and a coil spring 66 is disposed in the space 58 so that the thick circular plate portion 64*c* of the heat transmission delay member 64 is press-fitted to the bottom surface of the diaphragm stopper portion 49*b* by spring force of the coil spring 66. That is, the coil spring 66 is a supplementary means for fixing the heat transmission delay member 64 to the heat transmission rod 49.

In the fourth embodiment, even if the holding force the resin material of the heat-transmission delay member 64 is decreased after being used for a long time, the heat-transmission delay member 64 can be tightly fixed by the spring force of the coil spring 66.

In the fourth embodiment, because the coil spring 66 is disposed in the space 58, the refrigerant flow in the evaporator outlet side passage 48 is not interrupted by the coil spring 66.

A fifth preferred embodiment of the present invention will be described with reference to FIGS. 6A and 6B.

Figure 6A:
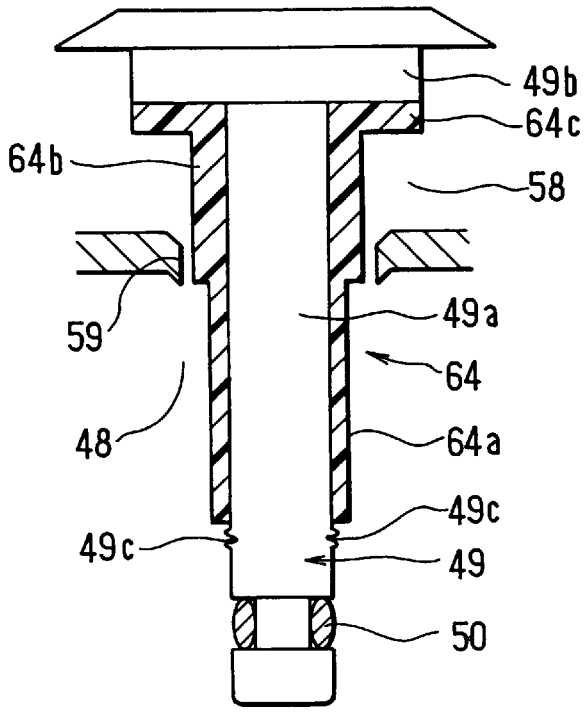
FIG. 6A is a cross-sectional view showing a main portion of a thermal expansion valve according to a fifth preferred embodiment of the present invention.
Figure 6B:
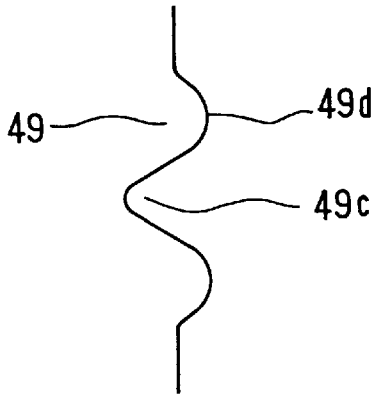
FIG. 6B is an expanded view showing a main portion of FIG. 6A.

As shown in FIGS. 6A and 6B, the heat transmission delay member 64 is press-fitted to the small-diameter shaft portion of the temperature sensing rod 49, and a plurality of recess portions 49*c* (e.g., 2–3 recess portions) are formed by punching on the temperature sensing rod 49 at a position corresponding to the top end of the thin cylindrical portion 64*a* of the heat transmission delay member 64. Around the recess portions 49*c,* a protrusion portion is formed to engage with the top end of the thin cylindrical portion 64*a*.

Thus, even if the holding force the resin material of the heat-transmission delay member 64 is decreased after being used for a long time, the heat-transmission delay member 64 can be tightly fixed to the temperature sensing rod 49 by the engagement between the protrusion portion 49*d* formed on the temperature sensing rod 49 and the heat transmission delay member 64.

A sixth preferred embodiment of the present invention will be described with reference to FIGS. 7A and 7B.

Figure 7A:
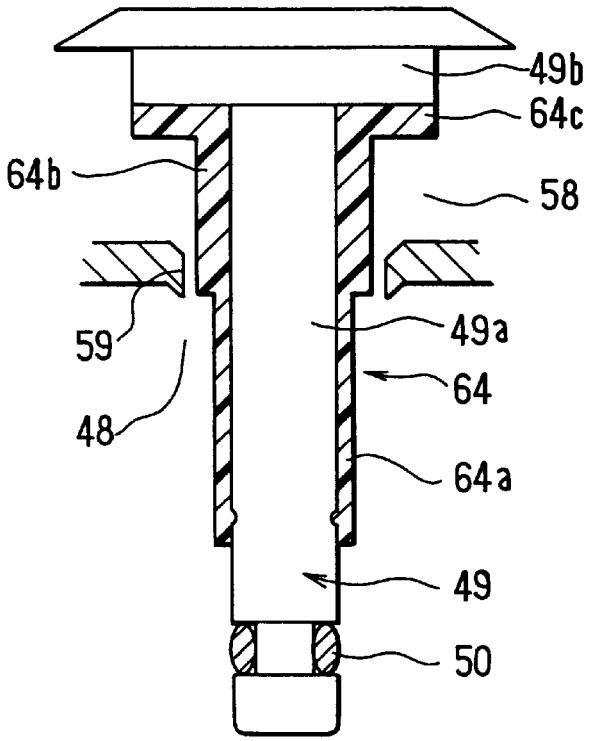
FIG. 7A is a cross-sectional view showing a main portion of a thermal expansion valve according to a sixth preferred embodiment of the present invention.
Figure 7B:
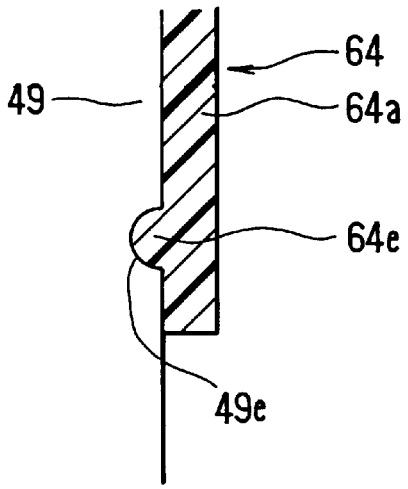
FIG. 7B is an expanded sectional view showing a main portion of FIG. 7A.

As shown in FIGS. 7A and 7B, the heat transmission delay member 64 is press-fitted to the small-diameter shaft portion of the temperature sensing rod 49, and a plurality of recess portions 49*e* (e.g., 2–3 recess portions) are formed on the temperature sensing rod 49 at a position corresponding to the top end portion of the thin cylindrical portion 64*a* of the heat transmission delay member 64. on the other hand, protrusion portions 64*e* are formed on the inner peripheral surface of the thin cylindrical portion 64*a* at the top end side to press-insert the protrusion portions 64*e* into the recess portions 49*e*.

Thus, even if the holding force the resin material of the heat-transmission delay member 64 is decreased after being used for a long time, the heat-transmission delay member 64 can be tightly fixed to the temperature sensing rod 49 by the engagement between the protrusion portions 64*e* and the recess portions 49*e*.

Alternatively, recess portions may be formed on the inner peripheral surface of the thin cylindrical portion 64*a* at the top end side, and protrusion portions may be formed on the temperature sensing rod 49 to engage with the recess portions.

Although the present invention has been fully described in connection with preferred embodiments thereof with reference to the accompanying drawings, it is to be noted that various changes and modifications will become apparent to those skilled in the art.

For example, a slit portion may be formed along the whole length of the cylinder shape of the heat transmission delay member 64 in an axial direction, the temperature sensing rod 49 may be inserted into the heat transmission delay member 64 by elastically deforming the heat transmission delay member 64 from the slit portion, and the heat transmission delay member 64 may be elastically fixed to the outer peripheral surface of the temperature sensing rod 49 by elastic force of the heat transmission delay member 64.

Further, as the material of the heat transmission delay member 64, a rubber type elastic material having a heat-conductivity similar to a resin may be used.

Such changes and modifications are to be understood as being within the scope of the present invention as defined by the appended claims.

What is claimed is:

1. A thermal expansion valve for a refrigerating cycle including an evaporator for evaporating refrigerant, said thermal expansion valve comprising:

a body case having an evaporator outlet side passage formed at an outlet side of said evaporator;

a valve body mechanism portion disposed in said body case, said valve body mechanism including a restriction passage for decompressing and expanding refrigerant and a valve body for adjusting an opening degree of said restriction passage;

a temperature sensing rod slidably disposed in said body case, for sensing a temperature of refrigerant passing through said evaporator outlet side passage;

a case member for forming therein a first pressure chamber for changing a pressure therein according to a temperature sensed by said temperature sensing rod and a second pressure chamber for introducing pressure of refrigerant in said evaporator outlet side passage thereinto;

a diaphragm disposed in said case member to partition said first pressure chamber and said second pressure chamber and being displaced according to a pressure different between both chambers, said diaphragm being connected to said valve body through said temperature sensing rod in such a manner that a displacement of said diaphragm is transmitted to said valve body through said temperature sensing rod to displace said valve body; and a heat transmission delay member disposed on said temperature sensing rod, for delaying heat transmission of said temperature sensing rod, wherein, said body case has a pressure-introducing space for communicating said evaporator outlet side passage and said second pressure chamber, said temperature sensing rod includes a shaft portion placed in said evaporator outlet side passage and said pressure-introducing space, and a diaphragm stopper portion connected to an end of said shaft portion and contacting said diaphragm, and said heat transmission display member includes a first cylindrical portion which covers a part of said shaft portion, disposed in said evaporator outlet side passage and a second cylindrical portion which covers a part of said shaft portion, disposed in said pressure-introducing space, said first cylindrical portion and said second cylindrical portion being connected to form a step portion, said step portion not being disposed in said evaporator outlet side passage.

2. A thermal expansion valve according to claim 1, wherein, said first cylindrical portion has a thickness, and said thickness of said first cylindrical portion is thinner than that of said second cylindrical portion.

3. A thermal expansion valve according to claim 1, wherein said heat transmission delay member is made of a material having a heat conductivity smaller than that of said temperature sensing rod.

4. A thermal expansion valve according to claim 1, wherein said heat transmission delay member includes a circular plate which covers said diaphragm stopper portion of said temperature sensing rod and has a thickness thicker than that of said first cylindrical portion.

5. A thermal expansion valve according to claim 1, wherein, said first cylindrical portion is press-fitted to said temperature sensing rod to form a clearance between said second cylindrical portion and said temperature sensing rod.

6. A thermal expansion valve according to claim 5, wherein said clearance between said second cylindrical portion and said temperature sensing rod is approximately 0.1 mm.

7. A thermal expansion valve according to claim 4, wherein, said heat transmission delay member is made of a resin, and said first cylindrical portion, said second cylindrical portion and said circular plate are formed integrally.

8. A thermal expansion valve according to claim 1, wherein said heat transmission delay member is press-fitted to said temperature sensing rod.

9. A thermal expansion valve according to claim 1, further comprising:

supplemental fixing means for supplementally fixing said heat transmission delay member to said temperature sensing rod.

10. A thermal expansion valve for a refrigerating cycle including an evaporator for evaporating refrigerant, said thermal expansion valve comprising:

a body case having an evaporator outlet side passage formed at an outlet side of said evaporator;

a valve body mechanism portion disposed in said body case, said valve body mechanism including a restriction passage for decompressing and expanding refrigerant and a valve body for adjusting an opening degree of said restriction passage;

a temperature sensing rod slidably disposed in said body case, for sensing a temperature of refrigerant passing through said evaporator outlet side passage;

a case member for forming therein a first pressure chamber for changing a pressure therein according to a temperature sensed by said temperature sensing rod and a second pressure chamber for introducing pressure of refrigerant in said evaporator outlet side passage thereinto;

a diaphragm disposed in said case member to partition said first pressure chamber and said second pressure chamber and being displaced according to a pressure difference between both chambers, said diaphragm being connected to said valve body through said temperature sensing rod in such a manner that a displacement thereof is transmitted to said valve body through said temperature sensing rod to displace said valve body; and a heat transmission delay member disposed on said temperature sensing rod, for delaying heat transmission of said temperature sensing rod, wherein, said body case has a pressure-introducing space for communicating said evaporator outlet side passage and said second pressure chamber, said temperature sensing rod includes a shaft portion placed in said evaporator outlet side passage and said pressure-introducing space, and a diaphragm stopper portion connected to an end of said shaft portion and contacting said diaphragm, said heat transmission delay member includes: a first cylindrical portion which covers a part of said shaft portion, disposed in said evaporator outlet side passage; a second cylindrical portion which covers a part of said shaft portion, disposed in said pressure-introducing space; and a circular plate which covers said diaphragm stopper portion of said temperature sensing rod, said first cylindrical portion, said second cylindrical portion and said circular plate are formed integrally by a resin material, and said heat transmission delay member is press-fitted to said temperature sensing rod.

11. A thermal expansion valve according to claim 10, wherein, said first cylindrical portion has a thickness, and said thickness of said first cylindrical portion is thinner than that of said second cylindrical portion.

12. A thermal expansion valve according to claim 11, wherein said thickness of said first cylindrical portion is thinner than that of said circular plate.

13. A thermal expansion valve according to claim 10, wherein said heat transmission delay member is made of a material having a heat conductivity smaller than that of said temperature sensing rod.

14. A thermal expansion valve according to claim 10, wherein, said first cylindrical portion and said second cylindrical portion are connected to have a step portion therebetween, and said step portion is not disposed in said evaporator outlet side passage.

15. A thermal expansion valve according to claim 10, further comprising:

supplemental fixing means for supplementally fixing said heat transmission delay member to said temperature sensing rod.

16. A thermal expansion valve for a refrigerating cycle including an evaporator for evaporating refrigerant, said thermal expansion valve comprising:

a body case having an evaporator outlet side passage formed at an outlet side of said evaporator;

a valve body mechanism portion disposed in said body case, said valve body mechanism including a restriction passage for decompressing and expanding refrigerant and a valve body for adjusting an opening degree of said restriction passage;

a temperature sensing rod slidably disposed in said body case, for sensing a temperature of refrigerant passing through said evaporator outlet side passage;

a case member for forming therein a first pressure chamber for changing a pressure therein according to a temperature sensed by said temperature sensing rod and a second pressure chamber for introducing pressure of refrigerant in said evaporator outlet side passage thereinto;

a diaphragm disposed in said case member to partition said first pressure chamber and said second pressure chamber and being displaced according to a pressure different between both chambers, said diaphragm being connected to said valve body through said temperature sensing rod in such a manner that a displacement of said diaphragm is transmitted to said valve body through said temperature sensing rod to displace said valve body; and a heat transmission delay member disposed on said temperature sensing rod, for delaying heat transmission of said temperature sensing rod, wherein, said body case has a pressure-introducing space for communicating said evaporator outlet side passage and said second pressure chamber, said temperature sensing rod includes a shaft portion placed in said evaporator outlet side passage and said pressure-introducing space, and a diaphragm stopper portion connected to an end of said shaft portion and contacting said diaphragm, and said heat transmission display member includes a first cylindrical portion which covers a part of said shaft portion disposed in said evaporator outlet side passage, a second cylindrical portion which covers a part of said shaft portion disposed in said pressure-introducing space and a circular plate which covers said diaphragm stopper portion of said temperature sensing rod and has a thickness thicker than that of said first cylindrical portion, said heat transmission delay member being made of a resin, said first cylindrical portion, said second cylindrical portion and said circular plate being formed integrally.

17. A thermal expansion valve according to claim 16, wherein, said first cylindrical portion has a thickness, and said thickness of said first cylindrical portion is thinner than that of said second cylindrical portion.

18. A thermal expansion valve according to claim 16, wherein said heat transmission display member is made of a material having a heat conductivity smaller than that of said temperature sensing rod.

19. A thermal expansion valve according to claim 16, wherein, said first cylindrical portion and said second cylindrical portion are connected to have a step portion therebetween, and said step portion is not disposed in said evaporator outlet side passage.

20. A thermal expansion valve according to claim 16, wherein, said first cylindrical portion is press-fitted to said temperature sensing rod to form a clearance between said second cylindrical portion and said temperature sensing rod.

21. A thermal expansion valve according to claim 20, wherein said clearance between said second cylindrical portion and said temperature sensing rod is approximately 0.1 mm.

22. A thermal expansion valve according to claim 16, wherein said heat transmission delay member is press-fitted to said temperature sensing rod.

23. A thermal expansion valve according to claim 16, further comprising:

supplemental fixing means for supplementally fixing said heat transmission display member to said temperature sensing rod.

* * * * *